United States Patent [19]

Davis

[11] 4,415,889

[45] Nov. 15, 1983

[54] RASTER-SCANNED CRT DISPLAY SYSTEM WITH IMPROVED POSITIONAL RESOLUTION FOR DIGITALLY ENCODED GRAPHICS

[75] Inventor: William J. Davis, Thousand Oaks, Calif.

[73] Assignee: RCA Corporation, New York, N.Y.

[21] Appl. No.: 217,843

[22] Filed: Dec. 18, 1980

[51] Int. Cl.[3] ..... G09G 9/16

[52] U.S. Cl. ..... 340/728; 340/727; 340/748; 358/133; 358/280

[58] Field of Search ..... 340/731, 728, 727, 723, 340/744, 748, 27 NA, 703; 358/133, 260, 280

[56] References Cited

U.S. PATENT DOCUMENTS 3,868,672 2/1975 Johnson ..... 340/736

*Primary Examiner*—Marshall M. Curtis

*Attorney, Agent, or Firm*—Joseph S. Tripoli; Robert L. Troike; Allen L. Limberg

[57] ABSTRACT

In a raster-scanned kinescope display resolution in the direction of slow sweep tends to be limited by the spacing between adjacent scan lines in the direction of fast sweep. Auxiliary minor deflection at video rate is used to improve the positional resolution of the display in the direction of slow sweep.

13 Claims, 8 Drawing Figures

RASTER-SCANNED CRT DISPLAY SYSTEM WITH IMPROVED POSITIONAL RESOLUTION FOR DIGITALLY ENCODED GRAPHICS

The invention relates to raster-scanned cathode ray tube (CRT) display systems for the display of digitally encoded graphics and, more particularly, to improvements in the positional resolution of the displays provided by such systems.

The embodiment of the invention to be particularly described is incorporated in an electronic flight instrument (EFI) to be used in an aircraft cockpit to replace the presently employed electromechanical attitude-director indicator (ADI) or horizontal situation indicator (HSI). However, the broader aspects of the invention have application in similar systems—such as video gaming apparatus using a kinescope dedicated to that apparatus, by way of example.

Stroke writing can produce the highest quality CRT presentation of digitally encoded graphics such as lines, symbols, and alphanumerics. These digitally encoded graphics are conventionally supplied to the CRT display system from a digital memory system used as a buffer between a digital computer generating the digitally-encoded graphics and the CRT display system displaying the graphics. In superior stroke writing systems each electron gun projecting an electron beam used in writing the display element—e.g., a line—is turned off until the beam deflection system can arrange the electromagnetic field controlling the path a beam electron will follow so that each beam is at the starting point of the element to be written, whereupon each electron gun projecting an electron beam used in writing the display element is turned on. In superior stroke writing systems each electron beam used in writing the display element is then moved at constant velocity across the electroluminescent screen at the face of the CRT, independent of the direction of beam travel, to produce a stroke of uniform intensity and width. When the display element is written, each electron gun used to project the electron beam used to write that display element is turned off; and the beam deflection system arranges the field controlling the path a beam of electrons will follow such that a beam will impinge on the electroluminescent screen at the starting point of the next display element to be written, which will then be written in similar manner to the writing of the display element just described. This is so-called "jump scan". In sophisticated stroke-writing CRT display systems various measures are taken to reduce the power dissipated in the deflection amplifiers during the jump scans, while at the same time keeping the time consumed by the jump scans in adequately small proportion to the time consumed in writing the display elements.

Nonetheless, the power dissipated in the deflection amplifiers of a jump-scanned CRT display system is much greater than that needed to be dissipated in the deflection amplifiers of a raster-scanned CRT display system in which each electron beam is recurrently swept across the electroluminescent screen of the CRT in a first direction (for example, from left to right) at a relatively fast rate and in a second direction orthogonal to the first (continuing the example, from top to bottom) at a relatively slow rate, in a manner analogous to that employed in the kinescopes used to display broadcast television video information. This is because the totally recurrent nature of the deflection waveform supplied by the deflection amplifier associated with deflection in the first direction, allows the reactive load presented by the deflection system to be resonated by another reactance. Accordingly, much the same energy can be recycled back and forth between them to generate the rapid field changes required for properly directing the electron path in the first direction, with the deflection amplifier only having to supply sufficient energy to supply the relatively small resistive losses in the system. Raster-scanning can typically save fifty to sixty watts of dissipation in the deflection amplifier of a CRT with 10 cm. diagonal scanned with sixty 256-line fields per second. This is a very significant saving in airborne equipment. It can reduce or eliminate the need for forced-air cooling and the weight and cost of the mechanical equipment required to provide it. It can reduce the weight of heat-sinks surrounding the power dissipating components of the deflection amplifier used for rapid deflection as well.

The brightness of a raster scan is inherently uniform since the velocity of scan with which the electron beam path is swept across the electroluminescent screen is constant in a well-designed system, so stroke writing offers no advantage in this regard. Where the CRT screen needs to be illuminated only in small portions thereof velocity of scan in the stroke writing system during writing can be reduced below that in an equivalent raster-scanned system to permit more intensive irradiation of the screen and consequently brighter display. However, normally, in the cockpit video display, large portions of the screen are written.

The raster-scanned display systems tend to have less complexity in their support electronics than strokewriting display systems if considerable amounts of data are to be handled with reasonably frequent refreshing of the display. The raster-scanned systems also may enjoy the advantage that they lend themselves to the use of kinescopes and deflection components used in commercial television receivers. These standard parts are relatively inexpensive compared to custom parts, owing to the large volumes in which these standard parts are made.

In a broadcast television receiver the information to be displayed is generated by a line-by-line scanning process whether the information comes directly from iconoscope, vidicon, or flying-spot scanner or through the intermediation of an electromagnetic or electrooptic recording system. This means that the reproduction of line drawings, particularly where the lines to be reproduced are at a shallow angle respective to the direction of rapid scan, involves the generation of video signals of analog nature, varying in amplitude to vary the intensity of the beam sweeping the face of the display kinescope as the line to be reproduced crosses from the region through which it is reproduced on one rapid scan to the region in the adjoining rapid scan. This gives the viewer the impression that vertical resolution is substantially as good as horizontal resolution, and straight lines at a shallow angle to the direction of rapid scan do not exhibit marked step discontinuities in them.

In a system where digitally generated graphics are to be displayed, the display information usually is binary in nature. An electron gun at any instant of time is completely turned on, completely turned off, or making a rapid transition between one of these conditions and the other. A narrow line written at an angle to the direction of rapid scan will in a raster presentation at any time always be resolved into one or another of two adjoining scan lines, causing step discontinuities in the written line. Where its angle to the direction of rapid scan is very small—say, a slope of one on a few hundred—a narrow straight line extending across the kinescope face will be resolved into two lines extending in the direction of rapid scan, which lines are joined by a single step discontinuity. As the angle the narrow straight line extending across the kinescope face makes with the direction of rapid scan increases, so it is resolved into an increasing number of scanning lines, the number of step discontinuites increases. The line takes on the appearance of a staircase with risers of a height equal to the spacing between sweep lines. This effect tends to be made still more noticeable by the fact that field interlace is usually not employed in display systems using digitally generated graphics, in order to maintain uniform brightness along a written line. During rotation, translation, or both, of the straight line presentation, an annoying crawling of step discontinuities along the line will be noticed by a person viewing the display.

The problem of step discontinuities may also be viewed as a problem arising from insufficient vertical resolution, with the upper limit on the vertical resolution of conventional raster scanning being set by the number of scanning lines in the raster field. The upper limit on the resolution of the display in the direction of rapid sweep, assuming spot size not to be a limiting factor, is proportional to the bandwidth of the video signal turning the electron gun on and off and is inversely proportional to the rate of rapid sweep.

The practical limits on vertical and horizontal resolution in a conventional raster-scanned CRT display system do not extend much beyond those employed in conventional broadcast television, but resolution so limited is insufficient to resolve slant line vectors without noticeable step discontinuities, so long as each CRT beam has its intensity modulated in binary fashion to be either "on" or "off". Further, the memory requirements for the digitally coded graphics become uneconomically large as one increases the number of picture elements ("pixels," for short) in the display past the 250,000 or so used in broadcast television, in a straightforward attempt to increase horizontal and vertical resolution. For example, a monochromatic display provided by the square array of 4,096×4,096 ($2^{12}\times2^{12}=2^{24}$) pixels needed to suppress step discontinuities in slanted line vectors satisfactorily, will require $2^{24}$ (or about 16 million) bits of refresh memory and $2^{24}$ bits of update memory. A three-color display requires twice as much memory capability, since two bits are required to indicate which of the three colors or none appears at each pixel in the display. Video bandwidth requirements are an impractically high 65 MHz if the display is to be refreshed sixty times a second.

The invention contemplates a raster-scanned CRT display system where the number of pixels in the array is kept within easily realized bounds not extending appreciably, if at all, beyond those used in broadcast television. These bounds should be such that the resolution of vertical and horizontal line vectors is good, since the corrections for staircasing effects to be described do not apply to them, and it is convenient to have inherently sufficient resolution for alphanumerics as well.

The invention is founded on the insight that the resolution required for positioning a slanted straight line vector in the display without noticeable step discontinuities is many, many times greater than that required to define the line were it horizontally or vertically disposed. A 4,096×4,096 array of pixels is needed for the former task, while the latter task may be accomplished by a 256×256 (or $2^8\times2^8$) array, for example. One needs only 256×256 or $2^{16}$ bits of refresh memory and a similar amount of update memory to maintain a monochromatic display with such a reduced array of pixels, with twice as much memory required to maintain a three-color display.

Then, according to an aspect of the invention, the pixels in such a reduced array are adjusted from their normal position on the CRT display screen by fractions of the spacing between the normal scan lines using an auxiliary vertical deflection system, which permits improving the positional resolution of line vectors, the auxiliary vertical deflection system being non-resonant in nature to allow such adjustment to be made at video rates. The adjustment at video rates can be made by this auxiliary deflection system with reasonable amounts of power, since in either direction it is at most half the distance between scan lines. Furthermore, there is a considerable amount of time available for calculating the adjustment to be made since the display content changes rather slowly, being limited by the rate at which the aircraft changes pitch and roll in the case of an electronic ADI, and being limited by the response rate of the well-damped servo loops in the case of video monitoring of various electromechanical systems. Developing positional resolution using deflection, rather than increasing the number of pixels in the raster, means that the memory requirements for improved positional accuracy in a color CRT display are no greater than for a monochromatic CRT display, since any electron beam in the CRT is subject to the same electrostatic and electromagnetic field variations.

The total refresh memory required to provide a 16:1 (i.e. a $2^4$:1) improvement in vertical resolution is 256×256×4—note, 256×256×4, rather than 256×256×16, since the 16 levels can be coded in four binary digits—or $2^8\times2^8\times2^4=2^{20}$ bits; and the total update memory requirement is similar. A similar horizontal auxiliary deflection system (or its functional equivalent using step-variable delay in normal video drive to the display CRT) can be used with an increase in memory requirements similar to those required by the vertical auxiliary deflection system. Thus, to get positional resolution equivalent to that provided by a 4,096×4,096 array of pixels, one only requires (256×256×4)+(256×256×4)+(256×256)=256×256×9 bits of memory, plus another 256×256 bits of memory if the display is three-colored rather than monochromatic. That is, refresh and update memory requirements are each about half a million bits, rather than sixteen million bits. The invention, then, permits about a thirty-two times reduction in the memory capacity required for positional resolution equivalent to that provided by a 4,096×4,096 pixel array, while reducing the video bandwidth required to write the display by 16 times to about 4 MHz (of the same order as that used in broadcast television).

Figure 1:
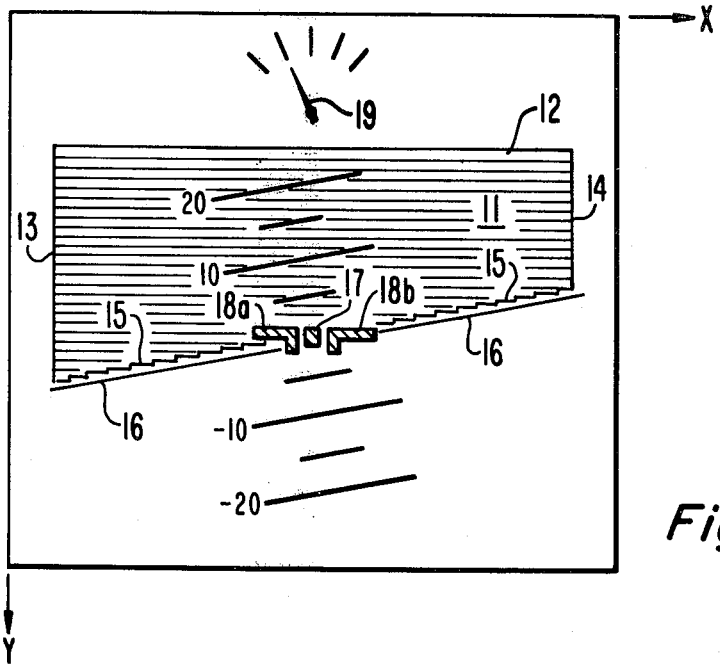
FIG. 1 is an illustration of the appearance of the CRT display that presents attitude-director information, with elements of that display being vectors inclined respective to horizontal trace direction.

FIG. 1 depicts a frontal view of the screen of a representative cockpit CRT display, which replaces the electromechanical ADI for providing a pilot with pitch and roll information concerning the flight of his aircraft, as that screen appears when his aircraft is in level flight, banking to the left as may occur during a turn or a slip to the left. A solid field 11 of blue color represents that portion of the pilot's view above his horizon, has a horizontal upper boundary 12, has vertical right and left boundaries 13 and 14, and has a lower boundary 15 roughly conforming to a yellow horizon-line vector 16 which rotates position according to the degree to which the aircraft banks. The relative insensitivity of the eye to blue details makes it unnecessary to correct the step discontinuities in the boundary 15, but the relative sensitivity of the eye to yellow details makes it desirable to correct the step discontinuities in horizon-line vector 16. Parallel to horizon line vector 16 are scale graduations in green, indexed 20, 10, −10 and −20 and subgraduations thereof also in green; step discontinuities in these green lines are to be corrected. The indexing numbers 20, 10, −10 and −20 are alphanumerics appearing in green on the screen. The lower left corners of their respective positions rotates together with the horizon-line vector 16 around element 17, but the alphanumerics remain upright as their positions are rotated. Element 17, green and stationary upon the CRT screen, is a stylistic representation of the fuselage of the aircraft; and elements 18*a* and 18*b*, also green and stationary upon the CRT screen represent the left and right wings, respectively, of the aircraft. A green pointer 19 is displayed on an axis passing through element 17 and bisecting horizon-line vector 16 perpendicularly at all angles of roll, and is arched over by a fan-like array of stationary green graduations that are indices of the angle of aircraft roll or bank. Pointer 19 and these roll angle indices desirably have their inherent step discontinuities corrected for.

If the aircraft climbs, the horizon-line vector 16, the lower boundary 15 of blue field 11 parallel to 16, the graduations parallel to 16, their alphanumerics and subgraduations are all translated downward in like amounts from the positions shown in FIG. 1. Conversely, if the aircraft dives, these display elements are all translated upward in like amounts from the positions shown in FIG. 1.

The displays described may all be considered to be formed from an array of individual picture cells (pixels, for short) their respective locations being arranged in adjacent horizontal rows and adjacent vertical columns, which locations may be provided with Cartesian coordinate addresses, with their respective column positions expressed on integral values along an x axis and their respective row positions expressed in integral values along a y axis. Conventional raster scanning of a television display as normally viewed scans left-to-right and top-to-bottom during the painting of picture on the screen by the electron beam. So, the x and y coordinates of the pixels in the display have their origin at top left of the screen; the x axis extends positively towards the right as in conventional analytic geometry notation, but the y axis extends positively downwards contrary to conventional analytic geometry notation. Angles are measured clockwise with a line vector parallel to positive direction along x axis having a bearing of zero degrees, which is also contrary to conventional analytic geometry notation.

Figure 2:
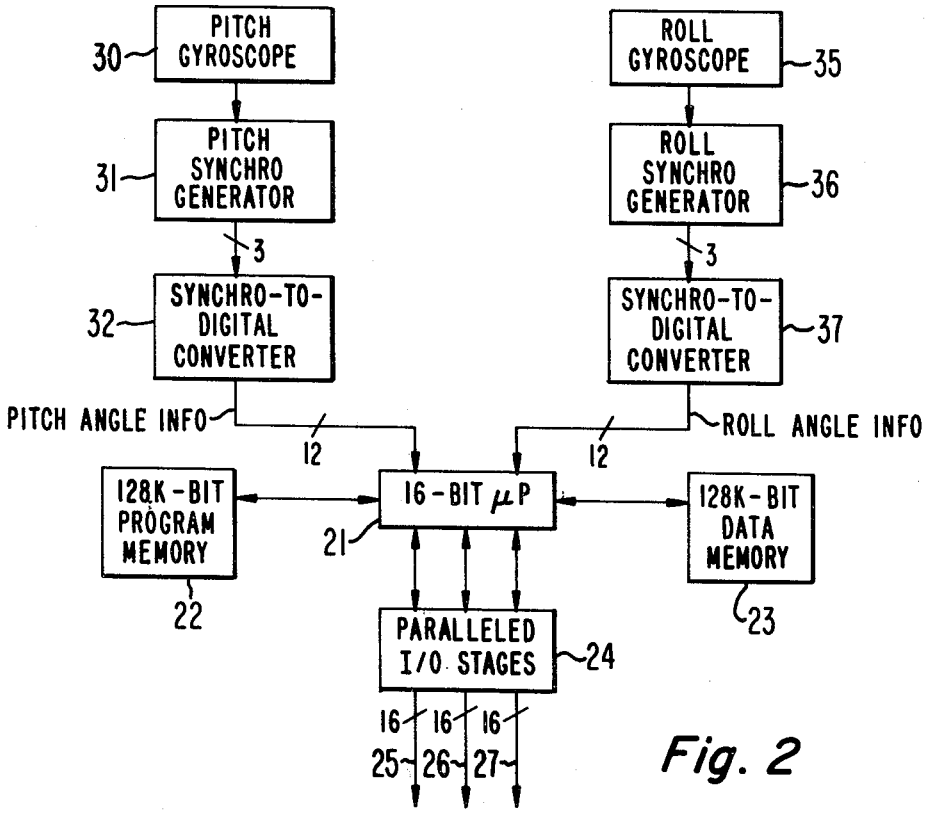
FIG. 2 is a block schematic diagram of the processor apparatus used to generate the data from which the display is generated.

In FIG. 2 a 16-bit microprocessor 21, a 128-kilobit program memory 22, and a 128-kilobit data memory 23 are the core of the computer, or processor, used for computing the coordinates of the beginning points and ending points of vectors, appearing in the display as lines or defining the boundaries of a field such as 11 of the FIG. 1 display, and for specifying the alphanumerics to be displayed together with the coordinates of their respective positions (which coordinates may, for example, be specified by the lower left corners of those alphanumerics). Data for generating the coordinates of the ends of fixed-position vectors in the display are stored in the data memory 23. Data for generating the coordinates of the ends of variable-position vectors are in part stored in data memory 23 as well, but are combined in the microprocessor 21 with further data—i.e., 12-parallel-bit words which relay pitch angle information, and twelve-parallel-bit words which relay roll angle information. The program memory 22 stores the program which directs the microprocessor 21 through the various steps required to compute the coordinates indicated at the beginning of this paragraph, which are clocked by paralleled input/output stages 24 at suitable times to 16-conductor buses 25, 26 and 27. The twelve-bit pitch angle information and roll angle information are also supplied by microprocessor 21 to the paralleled input/output stages 24 at times prescribed by program memory 22 to be clocked directly onto the buses 25, 26 and 27 at suitable times.

The pitch angle information is developed as follows. The precession of a gyroscope 30 in response to the aircraft changing its attitude respective to level flight is mechanically linked to a synchro generator 31, which generates cosine and sine components of a 400 Hz signal as an analog indication of the aircraft pitch angle. This analog indication is converted to 12-parallel-bit-word digital format by a well-known especial type of analog-to-digital converter, the synchro-to-digital converter 32. The roll angle information is developed similarly, the precession of a gyroscope 35 response to roll being mechanically linked to a synchro generator 36 to generate cosine and sine components of a 400 Hz signal converted to 12-parallel-bit-word digital format by a synchro-to-digital converter 37.

Figure 3:
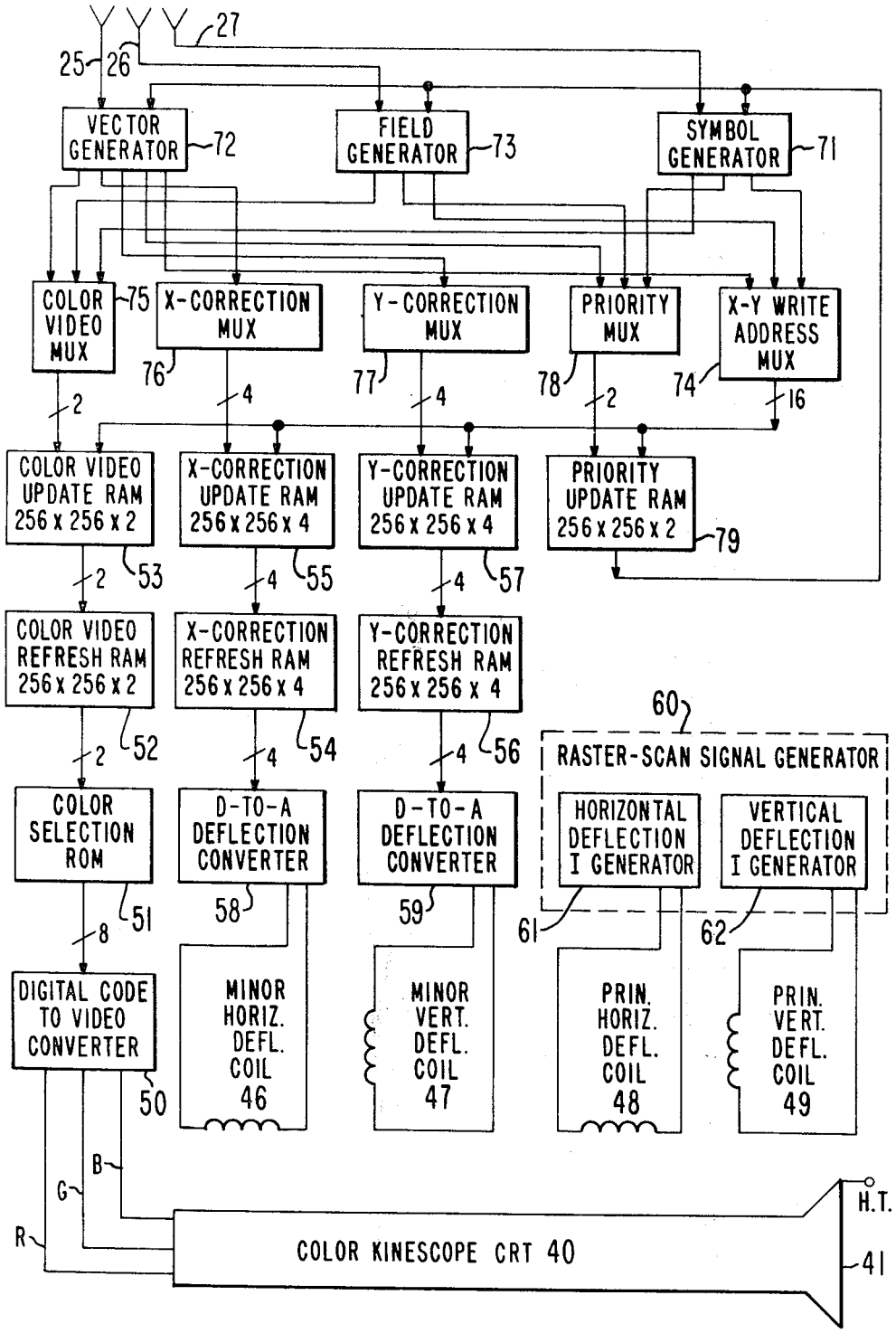
FIG. 3 is a block schematic diagram of the display generator apparatus for generating the display from that data, which apparatus embodies the invention.

In the FIG. 3 display generating apparatus, the density of the information to be displayed on the screen 41 of the color kinescope used as the display CRT 40 is to have equal horizontal and vertical resolution as determined by a square array of pixels with 256 rows and 256 columns. This provides for 256 scan lines per frame (i.e., 256 scan lines per field for the non-interfaced display), which substantially corresponds to the 262.5 scan lines per frame of conventional broadcast television. This substantial correspondence facilitates using broadcast television receiver components in the display. The frame rate is made to be 60 per second to keep flicker acceptably low. The 256 pixels per horizontal row of display take place in about 65 microseconds so the video bandwidth requirement is of the order of 4 MHz, which is low enough so that video amplifiers (not specifically shown) similar to those in broadcast television receivers can be used in the digital-code-to-video converter 50 driving the red, green and blue electron guns of CRT 40. The converter 50 would be simply a multiplexer for turning on one of the red, green or blue guns of CRT 40 where these primary colors were the only colors to appear in the display. But where other colors such as yellow or cyan are to be presented, converter 50 includes digital-to-analog converter circuitry to adjust the amplitudes of the drives to each of red, green and blue guns in appropriate mixture.

If the display comprising an array of pixels with 256 rows and 256 columns is a monochromatic display, the size of the random access memory (RAM) required to store the video information for refreshing this raster-scanned display would have to be a 256×256-bit or 64-kilobit memory; and a RAM of similar size would be used to update this refresh memory. Each 256×256-bit array of memory cells, each cell storing a bit of information associated with a particular one of the pixels in the 256×256 pixel array on the screen 41 of the CRT 40, will be referred to in this specification as a "plane" of memory.

In a color display of green, blue, and yellow (i.e., red plus green) illumination plus lack of illumination, the four possible display conditions can be specified by two bits per pixel, which are decoded by a color selection programmable read-only memory (ROM) 51 to provide digital input to the digital-code-to-video converter 50. As each pair of locations in the respective planes of the preceding random access memory associated with a respective pixel is scanned, the 8-conductor connection of ROM 51 to converter 50 allows ROM 51 to provide a converter 50 and 3 bits concerning red electron gun drive intensity, 3 bits concerning green electron gun drive intensity, and 2 bits concerning blue electron gun drive intensity. Since color selection ROM 51 requires 2 bits per pixel input information, the color video refresh RAM 52 of the FIG. 3 apparatus is a (256×256×2)-bit memory having two planes of 64-kilobit capacity and is recurrently updated from a color video update RAM 52, of similar capacity. In a system using a seven-color display (e.g., red, green, blue, magenta, cyan, yellow, and white) the capacity of the color-video update and refresh RAM's would each be increased in size to include another plane—e.g., increased to (256×256×3)-bit capacity—for a display of the same resolution.

The positional resolution in the x-direction is to be improved sixteen-fold and this requires an x-correction refresh RAM 54 with four planes of 64-kilobit capacity—i.e., a (256×256×4)-bit memory—and an x-correction update RAM 55 of similar capacity to update it. The positional resolution in the y-direction is to be improved sixteen-fold also, to which end y-correction refresh RAM 56 and y-correction update RAM 57 each of (256×256×4)-bit capacity are used. The update RAM's 53, 55 and 57 are truly random access memories and the cells in each of their planes can be addressed parallelly in any desired order.

The assembly of an updated display in update memories 53, 55 and 57 is completed during each one-twentieth second update-memory-write period and is then transferred and erased. The transferrals are to the refresh memories 52, 54 and 56 with which these update memories are respectively associated, and take place during an update-memory-read period preferably lasting for the one-sixtieth second period it takes to write a raster display on the screen 41 of CRT 40. These transfers preferably take place reading the cells in the update memories in the same order as the pixels associated with them are to be displayed on the screen 41 of CRT 40. Doing this permits the CRT 40 to be operated directly from update memory while the refresh memories 52, 54 and 56 are being updated. More particularly, during this update-memory-read and refresh-memory-write period, RAM 53 directs color selection ROM 51 to supply the digital code signals to digital-to-analog video converter 50 that control the video drive it applies to the electron guns of the CRT 40. During this same period RAM 55 supplies (at video rate) minor, correctional horizontal deflection information in four-parallel-bit digital code word format to a digital-to-analog power converter 58, which converts the code word to a minor-horizontal-deflection current applied to the minor horizontal deflection coil 46. And, during this same period RAM 51 supplies (at video rate) minor, correctional vertical deflection information in four-parallel-bit digital code word format to a digital-to-analog power converter 59, which converts the code word to a minor-vertical-deflection current applied to the minor vertical deflection coil 47.

Then, during the ensuing one-twentieth second update-memory-write period, while a new or updated display is being assembled, for next cycle of operation, the display on the screen 41 of CRT 40 is recurrently redrawn three times using data from the refresh memories 52, 54 and 56. Refresh memories 52, 54 and 56 need not be true random access memories, since they are recurrently cyclically scanned, but may be other rapid-access types instead.

A raster-scan generator 60, much like that used in conventional commercial broadcast television receivers is associated with CRT 40. It comprises a horizontal-deflection-current generator 61 and a vertical-deflection-current generator 62 which generate the deflection currents applied to deflection coils 48 and 49, respectively, for conditioning these coils to develop the principal components of the electromagnetic fields that deflect any electron beam in CRT 40 in the horizontal direction and in the vertical direction, respectively. These principal deflection field components provide for the raster-scanning of the entire screen 41 of CRT 40, and they are perturbed by minor deflection field components developed by the coils 46 and 47, respectively.

These minor deflection coils 46 and 47 may, for instance, be few-turns printed-circuit coils on flexible plastic sheeting, rolled into a tube to be placed under a conventional saddle-yoke configuration of major deflection coils 48 and 49, as used in the prior-art for increasing the width of strokes by spot-wobbling. The use of minor deflection coils, separate from the principal deflection coils, permits the minor deflection coils to be operated with the wide bandwidth required for deflection at video rates (easy to do, since these coils do not have a lot of turns nor the consequently large inductance) while the major deflection coils can have the narrow bandwidth associated with their being resonated by respective capacitors (particularly important in obtaining rapid horizontal retrace without high power consumption). The filtering action of major deflection coils connected to have such narrow bandwidths would, of course, preclude the successful application of deflection information to them at video rates to perturb the deflection fields at video rates.

The same timing generator (not shown) which controls the read-out of the RAM's 52-57 (and thus the write-in of refresh RAM's 52, 54 and 56) controls the timing of the scans generated by the horizontal and vertical deflection current generators 61 and 62, so that the major and minor deflection currents are generated in proper respective timing, the timing of these control functions being derived by counting down from a master clock oscillator (not shown). As pointed out previously, update RAM's 53, 55 and 57 are truly random access memories; and the write-in of information to them is conducted asynchronously to this master clock oscillator controlling deflection timing.

In the case of the vertical deflection system, which conventionally employs a blocking or other flywheel oscillator to control the generation of vertical scan, the natural trace period of the oscillator is made longer than desired and synchronization is achieved by injecting into the oscillator, pulses of energy with repetition rate at the desired scan rate, each of which indicates a retrace period before the end of a natural trace period can be reached. These injected pulses, obtained from the vertical sync separator in a broadcast television receiver, are in the present system supplied, one per vertical scan interval, by the timing generator referred to above. This injection-lock synchronizing system is preferable over an automatic frequency and phase control (AFPC) system for the vertical deflection current generator because it takes less time to synchronize than the AFPC system, which typically takes a few display frames to be pulled into synchronization. The horizontal deflection current generator, with its faster scan rate, may use either injection-lock or AFPC for synchronizing it to the pulses supplied to it, one per horizontal scan interval, from the timing generator.

The 16-conductor data buses 25, 26 and 27 from the FIG. 2 processor apparatus supply data to a symbol generator 71, a vector generator 72 and a field generator 73, respectively, in the FIG. 3 display generator apparatus. The timing of the transfer of this data is, for example, done by the technique known as "handshaking" where a "ready" pulse is sent out (by connections omitted from the block schematics) from the FIG. 2 processor to the one of generators 71, 72 and 73 to which data is to be supplied. The selected generator then returns an "acknowledge" pulse confirmatory of its connection to the FIG. 2 processor. The processor then supplies the data word by word to the selected one of the generators 71, 72 and 73. The selected generator sends another acknowledge pulse to the FIG. 2 processor as each data word is ingested, and has an internal counter that keeps track of how many acknowledge pulses have been transferred to the processor. This count is used inside the generator to identify the nature of the 12-bit data word being received and to direct it to a selected register for storage.

In an embodiment of the system constructed by the inventor and his colleagues, twelve-bit data words are used. The symbol generator 71 receives three twelve-bit words per character. The first of these words includes the x address of a point in the character or symbol to be presented; and the second of these words, the y address. The third word includes two bits which are color code information for specifying the color of the character, two bits which are priority code information for determining whether or not the symbol will be written in place of field or line vector information, and five bits which specify the character to be generated. The other three bit positions in the third word are left unused.

The vector generator 72 receives a six-word message from the FIG. 2 processor. The first and second words are the x and y locations of the starting point of the vector generation process. The third and fourth words are the x and y locations of the ending point of the vector generation process. The fifth word is the angle the vector makes with a vector extending horizontally to the right, the 360° of arc being subdivided into 4,096 segments of arc by the 12-bit resolution. The sixth word is a control word with two bits of color code information specifying the color of the line to be written on the screen face, two bits of priority code information specifying whether or not the line vector will be written in place of field information (as it invariably is in the ADI display) or of characters generated by the symbol generator 71, and four bits of information specifying line vector width. The vector generator 72 outlines each of the color line vectors it generates with a black border one pixel wide, in effect drawing three parallel vectors seriatim, the first black, the second in the desired color, and the third also in black. The normally narrowest line vector width is two pixels. The field generator 73 receives a message with at least three groups of six-word messages, each defining one of the straight-line boundaries of the field in a format similar to that used to define the line vectors. The field is, however, not bordered in black.

Each of the generators 71, 72 and 73 supplies, as its output signal, a sequence of 16-bit x-y locations indicating the pixels in its portion of the display. Each of these 16-bit x-y locations is supplied together with two bits of priority code information and two-bits of color code information, carried forward in the generator from similar information supplied to it from the FIG. 2 processor together with the information used to enable the generator to carry forward its generation of display data. The color information, of course, indicates the color in which the display generated by that generator is to be written at the specified pixel locations, if the priority code information establishes that information to be more important than the information any other of the generators generates for those pixel locations.

Multiplexers 74–78 each sequentially poll for 800 nanosecond intervals the output signals from each of the generators 71, 72 and 73, as long as the data they can supply for writing a particular x-y location is of higher priority in assembling the new display than data already stored in the update RAM's 53, 55 and 57 with reference to that x-y location. In this polling process, the x-y address multiplexer 74 applies the 16-bit x-y location in the output signal of the selected one of generators 71, 72 and 73 to the addressing circuitry of each of the memory planes in the update RAM's 53, 55, 57 and in the priority RAM 79. The color video multiplexer 75 applies the two bits of color code information supplied by the selected one of generators 71, 72 and 73 to the data inputs to respective planes of the color video update RAM 53. The x-correction multiplexer 76 and y-correction multiplexer 77 apply their respective four bits of deflection correction information from vector generator 72 to the data inputs of respective planes of the x-correction update RAM 55 and y-correction update RAM 57 if vector generator 72 is the selected generator. Multiplexers 76 and 77 otherwise apply (by connections not shown in FIG. 3) the signal indicating zero deflection correction to these data inputs, supposing a simple system wherein positional resolution improvement is afforded line vectors only. (Of course, the teaching of the present invention can be extended to more sophisticated systems where positional resolution of alphanumeric strokes and of field boundaries are improved). The priority multiplexer 78 applies each of the two bits of priority code in the output signal of the selected generator to the priority update RAM 79 for writing into a respective one of its memory planes.

Priority update RAM 79, however, includes circuitry for comparing the priority code, supplied to it for writing into any x-y location in its two planes, with the priority code already stored at the x-y location in its two planes. If and only if the priority code of the incoming data is superior to the code stored in the priority update RAM 79 for that x-y location, the priority RAM 79 will send signal from its output to the generators 71, 72 and 73 enabling them to generate write-enable signals. These write-enable signals are applied (by connections not shown in FIG. 3) to the RAM's 53, 55, 57 and 79 for enabling their being written by the data supplied to their respective data inputs by multiplexers 76, 77, 78 and 75, respectively, from the selected one of the generators 71, 72 and 73. This writing time is about 150 nanoseconds. If the priority code of the incoming data fails to exceed that of the data stored in the priority update RAM 79 for the specified x-y location, RAM 79 fails to send signal from its output to enable the generators 71, 72 and 73 to supply write-enable signals to the RAM's 53, 55, 57 and 79; and these memories are not updated.

The symbol generator 71 receives from the FIG. 2 processor the 16-bit address code for one of the points in the symbol (e.g. its lower left-hand corner), a five-bit identity code indicating what symbol is to be extracted from read-only memory (ROM) in the generator 71, the two-bit color identification code indicating the color in which the symbol is to be written, and the two-bit priority code for that symbol. From this information and by referring to ROM the symbol generator 71 is able to supply the information for locating an alphanumeric anywhere on the screen 41 of the CRT 40.

Figure 4:
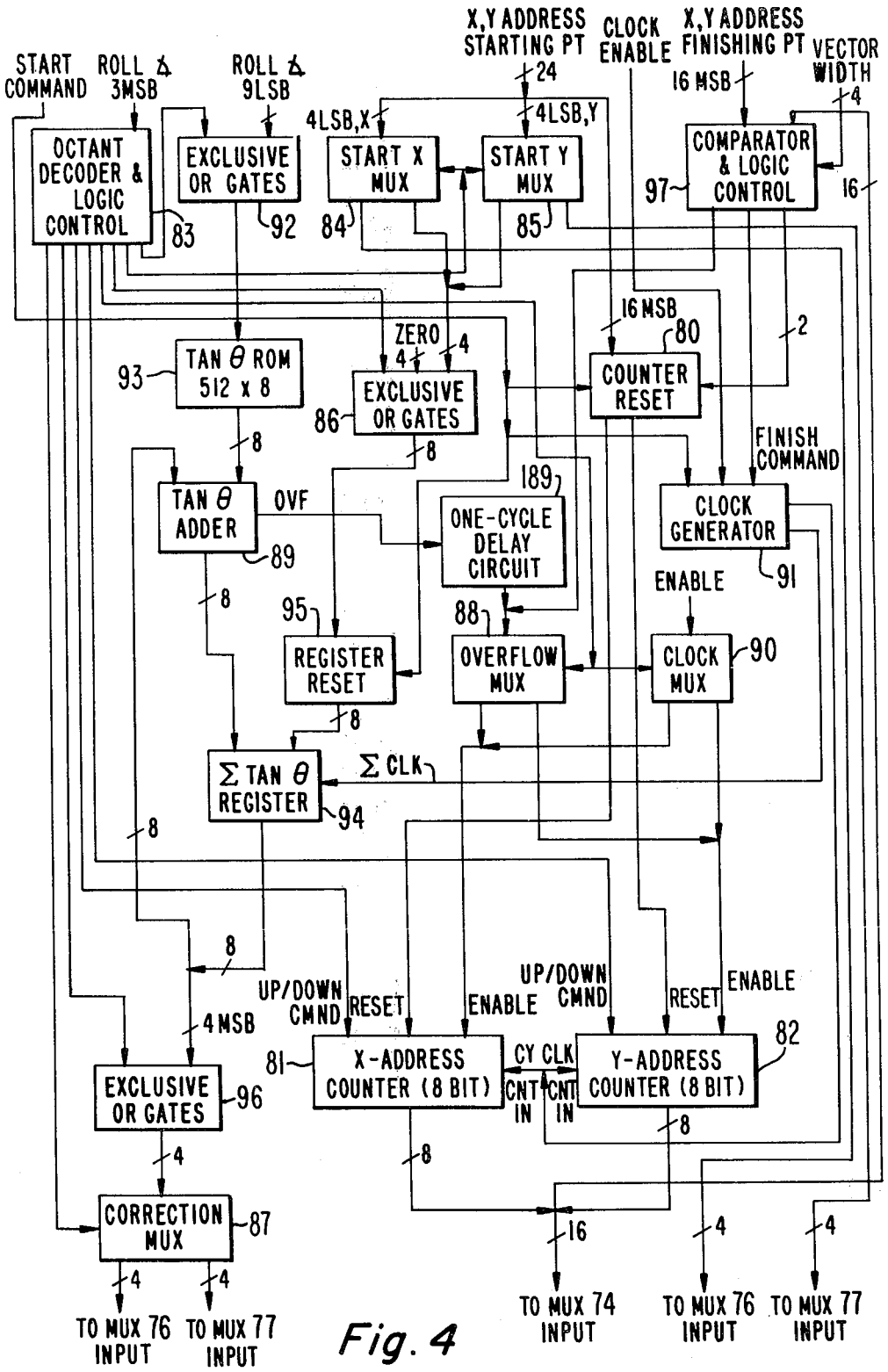
FIG. 4 is a detailed block schematic diagram of the portion of the FIG. 3 display generator apparatus used to generate line vectors.

The operation of the vector generator 72 will be explained with reference to the FIG. 4 block schematic and FIG. 5 timing diagram. A "start" command is generated within the vector generator 72 (by circuitry not shown in FIG. 4) a short time after vector generator 72 sends its sixth "acknowledge" pulse to the FIG. 2 processor, allowing sufficient time for the processor information to be loaded into input buffer registers of vector generator 72 (which are not shown in FIG. 4). Responsive to this "start" command counter reset circuitry 80 resets an x-address counter 81 and a y-address counter 82 to store the x and y coordinates $X_0$ and $X_0$, respectively, of the address of the line vector starting point. The x, y addressing of the RAM's 52–57 is controlled from x-address counter 81 and y-address counter 82. Each of these counters 81, 82 is an up/down counter, enabled by its "enable" input being supplied a "one" to be responsive to a cycle clock (CY CLK) pulse being applied to its "count" input, for incrementing its count output if an "up" command (e.g., a "one") is applied to its "up/down command" input, and for decrementing its count if a "down" command (e.g., a "zero") is applied to its "up/down command" input.

Octant decoder and logic control circuitry 83, used to control the logic of the vector generator 72 and hereinafter called simply "decoder", analyzes the three most significant bits of the roll angle information to determine which of the eight octants in 360° the vector angle falls in. The 3 bits of information respectively determine whether the vector is to be written left-to-right or right-to-left, whether the vector is to be written top-to-bottom or bottom-to-top, and whether the vector is closer to the vertical (in which case x-correction is to be used) or closer to the horizontal (in which case y-correction is to be used). It is convenient to generate the 45° and 215° vectors using x-correction and the 135° and 315° vectors using y-correction.

The x-address counter 81 is instructed to count up for vectors lying in any of the first, second, seventh, and eighth octants (0°–45°, 45°–90°, 270°–315° and 315°–360°, respectively) as well as for the 0°, 45° and 315° vectors; and counter 81 is instructed to count down for vectors lying in any of the third, fourth, fifth and sixth octants (90°–135°, 135°–180°, 180–225° and 225°–270°, respectively) as well as for the 135°, 180° and 225° vectors. This instruction can be determined by one of the two most significant bits in the binary number conveying roll angle information, with the other being used for instructing the direction of count by y-address counter 82. The y-address counter 82 is instructed to count up for vectors lying in any of the first through fourth octants as well as for the 45°, 90° and 135° vectors; and counter 82 is instructed to count down for vectors lying in any of the fifth through eighth octants as well as for the 215°, 270° and 315° vectors.

X-correction is not afforded on a scanning bit-by-bit basis for line vectors closer to the horizontal than to the vertical—i.e., for line vectors falling in the first octant including 0°, the fourth octant including 135°, the fifth octant including 180° and the eighth octant including 315°. Decoder 83 responds to these conditions to cause a start-x multiplexer 84 to apply its output (the four least significant bits of the x coordinate of the x, y address of the line vector starting point) to the data input of the x-correction multiplexer 76, rather than to respective first inputs of four of a battery 86 of eight exclusive-OR gates. This transports the extra resolution bits in the x coordinate directly to the input of the x-correction multiplexer 76 inasmuch as further x-correction is not afforded. To provide the y-correction decoder 83 directs start-y multiplexer 85 to apply the four least significant bits of the y coordinate of the x, y address of the line vector starting point to four of the first inputs of the battery 86 of eight exclusive-OR gates, rather than directly to the data input of the y-correction multiplexer 77. Data for determining y-corrections received at the input of a correction multiplexer 87 are directed to the data input of y-correction multiplexer 77, rather than to the input of x-correction multiplexer 76, per instruction of decoder 83, when y-correction is to be used rather than x-correction. Decoder 83 also directs an overflow multiplexer 88 to apply overflow bits taken from an adder 89 (and delayed by one count cycle in delay circuit 189) to the "enable" input of y-address counter 82, and directs a clock multiplexer 90 to apply a "one" continuously to the "enable" input of x-address counter 81 so that its count is advanced each cycle of operation by the CY CLK pulses applied to its "count" input. Y-correction is accomplished using the tangent (tan) of the roll angle information, so decoder 83 directs a battery 92 of nine exclusive OR gates to pass directly, without complementing, the nine least significant bits of the roll angle information to a read-only memory (ROM) 93 as angle $\theta$ to generate tan $\theta$ for application to the adder 89 used to add tan $\theta$ to the output of a $\Sigma$ TAN $\theta$ register 94.

Conversely, y-correction is not afforded on a scanning bit-by-bit basis for line vectors closer to the vertical than horizontal—i.e., for line vectors falling in the second octant including 45°, the third octant including 90°, the sixth octant including 225°, and the seventh octant including 270°. For these line vectors, the decoder 83 directs the following conditions. The start-x multiplier 84 is directed to apply its output to inputs of the battery 86 of exclusive-OR gates to implement further x-correction; and the start-y multiplexer 85 is directed to apply its output to the data input of y-correction multiplexer 77 inasmuch as no further y-correction will be afforded to the line vector. Correction multiplexer 87 is directed to apply output signal corresponding to its input signal to the data input of x-correction multiplexer 76, rather than to the data input of y-correction multiplexer 77. The overflow multiplexer 88 is directed to apply overflow bits taken from adder 89 (and delay one count cycle in delay circuit 189) to the "enable" input of x-address counter 81, rather than to the "enable" input of y-address counter 82. The clock multiplexer 90 is directed to apply a "one" continuously to the "enable" input of y-address counter 82, rather than to the "enable" input of x-address counter 81. The battery 92 of exclusive-OR gates are directed to complement the nine least significant bits of the roll angle information for application to TAN $\theta$ ROM 93, so tan $\theta$ corresponds to the cotangent rather than the tangent of the roll angle. This permits one ROM to supply both tangent and cotangent of roll angle information and halves the amount of ROM required for x- and y-correction.

The generation of summed tangent or cotangent roll angle information for correcting y or x position and shifting the y or x address counter is done on the basis of absolute (i.e., unsigned) angular deviation from horizontal or vertical axis. To pulse the count input of the y or x address counter appropriately, the decoder 83, responsive to roll angle being the first or second or fourth or seventh octant, directs the battery 86 of eight exclusive-OR gates to apply the four least significant bits of y or x address information received from multiplexer 85 or 84 and four ciphers to the 8-parallel-bit input of register reset circuitry 95 to be loaded into the $\Sigma$ TAN $\theta$ register 94 responsive to the "start" command. During each cycle of operation the $\Sigma$ TAN $\theta$ register has its output incremented by tan $\theta$, and the four most significant bits of its output is the desired y- or x-correction for that cycle. Accordingly, decoder 83 directs a battery 96 of four exclusive-OR gates to pass, without complementing, these four bits to the input of correction multiplexer 87.

Responsive to roll angle being in the third or fifth or sixth or eighth octant, on the other hand, decoder 83 directs the battery 86 of exclusive-OR gates to complement the four least significant bits of y or x address information and four ciphers for application to the 8-parallel-bit input of register reset circuitry 95. This action causes the four most significant bits of the output of the TAN $\theta$ register 94 to be the complement of the desired y- or x-correction for that cycle, so decoder 83 directs the battery 96 of exclusive-OR gates to complement these bits for application to the input of correction multiplexer 87.

The heart of the deflection-correction-generating apparatus is the accumulator connection of the TAN $\theta$ adder 89 and $\Sigma$ TAN $\theta$ register 94. Its operation will now be particularly described assuming the roll angle $\theta$ to be in the first quadrant between 0° and 45°. Then, $\theta$ equals the roll angle, and the batteries 86, 92 and 96 of exclusive-OR gates 92 generate output signals the same as their input signals. Overflow multiplexer 88 applies overflow information taken from adder 89 and delayed one count cycle in delay circuit 189 to the "enable" input of y-address counter 82, so counter 82 will count only selected ones of the CY CLK pulses supplied to its "count" input; and clock multiplexer 90 applies a continuously supplied "one" to the "enable" input of x-address counter 81 so it will count each of the CY CLK pulses applied to its "count" input. A $\Sigma$ CLK pulse is applied from clock generator 91 to register 94 at the finish of each operating cycle. This operating cycle varies in length depending on the results of the polling of generators 71, 72 and 73. If only vector generator 72 has information to update the display, clock generator 90 will be furnished a continuous CLOCK ENABLE signal from the circuitry polling the outputs of generators 71, 72 and 73, so the clock cycle will be its minimum 800 nanosecond (nS.) length. If one of the generators 71 and 73 has information available to update the display, the CLOCK ENABLE signal will be interrupted to extend the time between finish of CY CLK pulses and start of $\Sigma$ CLK pulses so cycle time will be 1.6 microseconds (mS.) If both generators 71 and 73 have information available to update the display the time between finish of CY CLK pulses and start of $\Sigma$ CLK pulses is extended to lengthen cycle time to 2.4 mS.

Figure 5:
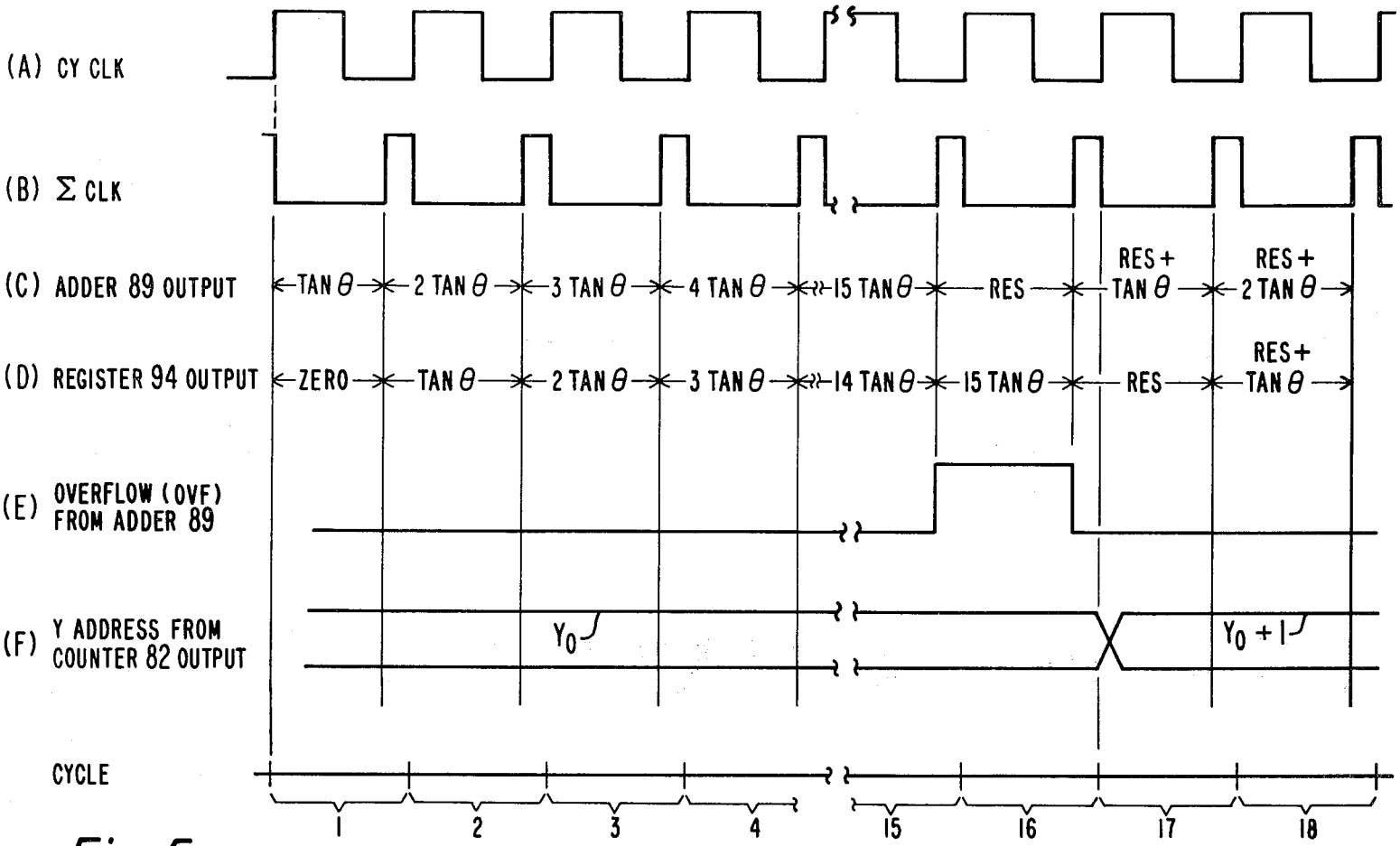
FIG. 5 is a timing diagram showing the time relationships between signals in the FIG. 4 vector generator.

FIG. 5 is a timing diagram showing the generation of y-correction information for a 3.8° roll angle, the tangent of which in binary numbers is 0.001 001, assuming the four least significant bits of the y address coordinate to be 0000, and assuming generators 71 and 73 do not have information available as data input to the update RAM's 52, 54, 56. At the close of the fifteenth cycle of operation adder 89 generates its overflow bit, which delayed by one count cycle in delay circuit 189 on the sixteenth cycle of operation advances the count in the y-address counter 82 output. The y-address will be incremented again each 16-cycle period for this value of roll angle; it would be incremented more or less frequently if the roll angle were bigger or smaller, respectively. The following table describes the conditions for each of the first sixteen cycles of operation shortly after its beginning, binary numbers being written most significant bit first.

| CYCLE # | ADDER 89 OUTPUT | REGISTER 91 OUTPUT | OVF | COUNTER 82 OUTPUT | MUX 77 INPUT |
|---|---|---|---|---|---|
| 1 | 0001 0001 | 0000 0000 | 0 | $Y_0$ | 0000 |
| 2 | 0010 0010 | 0001 0001 | 0 | $Y_0$ | 0001 |
| 3 | 0011 0011 | 0010 0010 | 0 | $Y_0$ | 0010 |
| 4 | 0100 0100 | 0011 0011 | 0 | $Y_0$ | 0011 |
| 5 | 0101 0101 | 0100 0100 | 0 | $Y_0$ | 0100 |
| 6 | 0110 0110 | 0101 0101 | 0 | $Y_0$ | 0101 |
| 7 | 0111 0111 | 0110 0110 | 0 | $Y_0$ | 0110 |
| 8 | 1000 1000 | 0111 0111 | 0 | $Y_0$ | 0111 |
| 9 | 1001 1001 | 1000 1000 | 0 | $Y_0$ | 1000 |
| 10 | 1010 1010 | 1001 1001 | 0 | $Y_0$ | 1001 |
| 11 | 1011 1011 | 1010 1010 | 0 | $Y_0$ | 1010 |

-continued

| CYCLE # | ADDER 89 OUTPUT | REGISTER 91 OUTPUT | OVF | COUNTER 82 OUTPUT | MUX 77 INPUT |
|---|---|---|---|---|---|
| 12 | 1100 1100 | 1011 1011 | 0 | $Y_0$ | 1011 |
| 13 | 1101 1101 | 1100 1100 | 0 | $Y_0$ | 1100 |
| 14 | 1110 1110 | 1101 1101 | 0 | $Y_0$ | 1101 |
| 15 | 1111 1111 | 1110 1110 | 0 | $Y_0$ | 1110 |
| 16 | 0001 0000 | 1111 1111 | 1 | $Y_0$ | 1111 |
| 17 | 0010 0001 | 0001 0000 | 0 | $Y_0+1$ | 0000 |
| 18 | 0011 0010 | 0010 0001 | 0 | $Y_0+1$ | 0001 |

The x-address counter 81 output will increment each cycle, responsive to a CY CLK pulse applied to the count input of counter 81. This operation continues until one of the x and y coordinates from counters 81 and 82 reaches the corresponding coordinate of the x, y address of the finishing point of the line vector as determined by a respective digital comparator in the comparator and logic control circuitry 97. If the x coordinate of the finishing point of the line vector is reached during the y-correction process, or if the y coordinate of the finishing point of the line vector is reached during the x-correction process, the comparator making that determination increments the count in a counter that keeps track of how many pixel widths of the line vector have had their address locations determined. The count in this width counter is then compared to the four bits of vector width information contained in the register storing the sixth control word last supplied to the vector generator 72 from the FIG. 2 processor. If the width count has not reached the appropriate value, the comparator making this comparison will supply a "one" to the overflow multiplexer 88. If the y-correction process is in progress, this changes the address stored in the y counter by unity; and the comparator and logic control circuitry 97 also directs counter reset circuitry 80 to reset the x-address counter 81 to the starting point x address. On the other hand, if the x-correction process is in progress, supplying the "one" to the overflow multiplexer 88 input changes the address stored in x counter by unity; and the comparator and logic control circuitry 97 directs counter reset circuitry 80 to reset the y-address counter 82 to the starting point y address. Then the addresses for points along the next pixel width of the line vector will be generated as for the pixel width of line vector just completed. (The offset of the starting and finishing point addresses from the center axis of the line vector in the direction across its width are compensated for in the FIG. 2 processor.)

If the count in the width counter corresponds to the desired line vector width, the comparator and logic control circuitry 97 furnishes a "finish" command which stops the further application of clock signals to the address counter and correction calculation circuitry. The "finish" command also instructs the polling circuitry polling the outputs of generators 71, 72 and 73 to skip over the vector generator 72 in its polling process.

During each cycle of operation from the application of "start" command to the generation of the "finish" command the vector generator 72 supplies a digital code describing the color of the line vector to the color video multiplexer 75 input. Vector generator 72 during each cycle of operation also supplies a digital code describing the priority of the line vector to the priority multiplexer 78 input. These digital codes are obtained from the registers used for storing the six input words last supplied to vector generator 72 from the FIG. 2 processor.

Field generator 73 can operate substantially the same as vector generator 72 with the field being painted by successive "strokes" of line vector. This approach takes up an appreciable amount of the total time available for updating the display when the field occupies a major fraction of the display. E.g., the blue field 11 representing the sky over the horizon 16 in the FIG. 1 display takes up about half of the active display area. This is somewhat less than $2^{15}$ elements to be written at 800 n S per bit rate, which takes about 25.6 mS. minimum time, about half of the 50 mS. total time available for update. If the rest of the display has substantial information content, this means the processor supporting the display generator must be very efficiently programmed to be able to update the display completely in the allowed time. The field generator 73 can be dispensed with, and the time for entering into update memory information concerning when the field is to appear can be considerably shortened, by resorting to a "field tab" method where the vectors describing the boundaries of a field of given color are generated by vector generator 72, are stored, and then are used to control the turning on and turning off of each electron beam required for scanning that color field.

Figure 6:
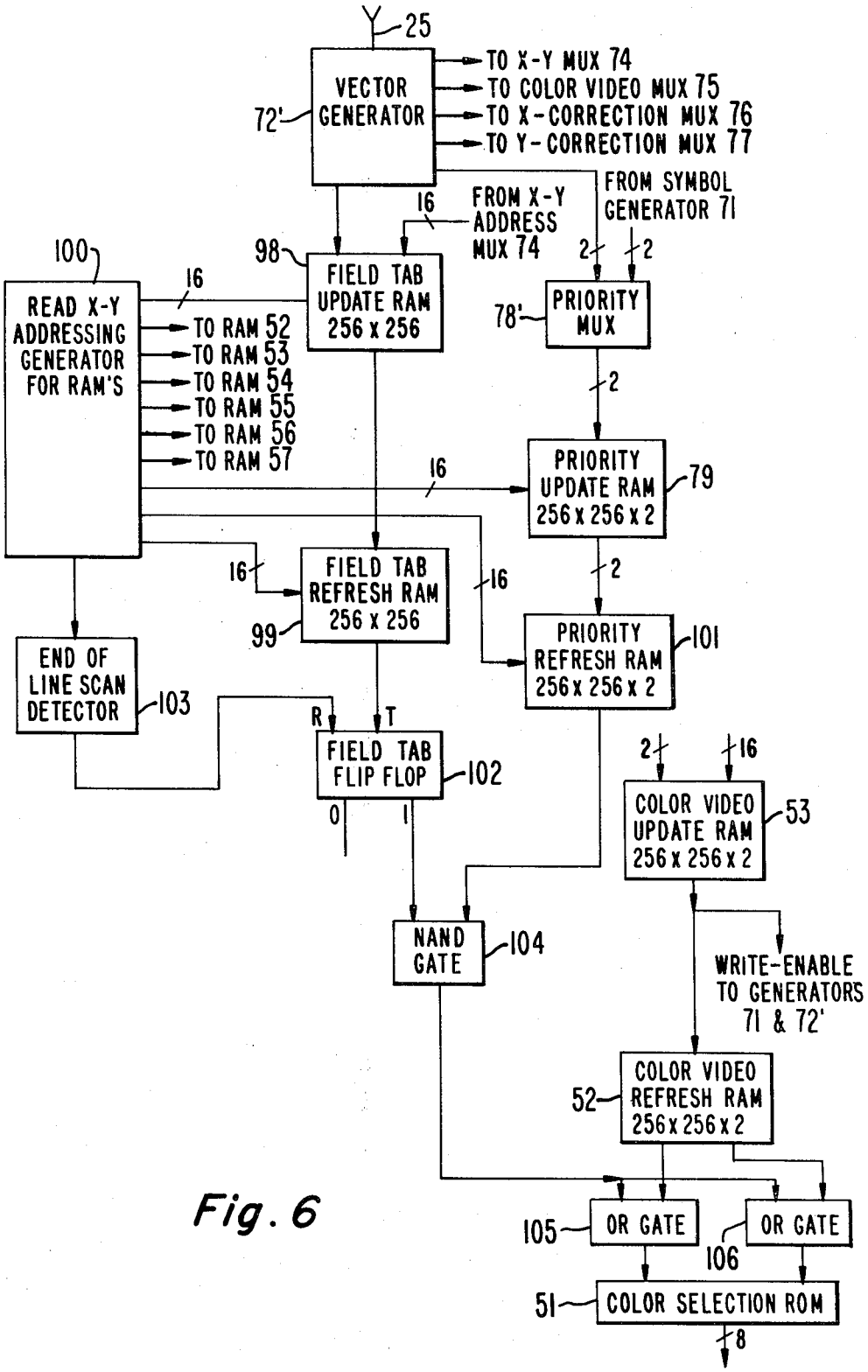
FIGS. 6 and 7 are block schematic diagrams of apparatus for generating field components of the display.

FIG. 6 shows more particularly how this is done. A modified vector generator 72' not only supplies the sixteen bits of x-y addressing information supplied to multiplexer 74, the four bits of color video information supplied to multiplexer 75, the four bits of x-correction supplied to multiplexer 76, the four bits of y-correction supplied to multiplexer 77, and the two priority bits to priority multiplexer 78' (modified from 78 since field generator 73 is no longer used). Vector generator 72' also supplies one bit of field tab information to a field tab update RAM 98, a single 256×256-bit memory plane which receives the x-y address information for its write cycle from x-y address multiplexer 74 output. Update RAM 98, like the other update RAM's 53, 55 and 57, supplies the information to be read out for writing every fourth frame of display. It also supplies during its read out the information for writing a field tab refresh RAM 99, also a single 256×256-bit memory plane, from which the information is taken to refresh the display for the next three frames.

The addressing of update RAM 98 during its being read, like that of update RAM's 53, 55, 57 and 79 (both here and in the FIG. 3 apparatus), is taken from read x-y addressing generator 100. This generator 100 typically comprises a 16-bit counter counting output pulses from a master clock oscillator and is used to supply x-y addressing both for reading and writing to the refresh RAM's 52, 54 and 56 (both here and in the FIG. 3 apparatus), field tab refresh RAM 99, and a priority refresh RAM 101 having two 256×256-bit memory planes for storing information supplied from the priority update RAM 79. It is convenient to use this same 16-bit counter to time the generation of the horizontal and vertical synchronization pulses for the raster scan generator 60 of FIG. 3, as well.

The single bit of field tab information supplied by vector generator 72' associated with each x-y address has one value for normal line vectors and another value for line vectors defining field boundaries—e.g., "zero" and "one", respectively—and is stored in RAM's 98 and 99. So as each display frame is read out of memory, the field tab bits associated with a field boundary—e.g., the "ones"—trigger a flip-flop 102, so each field tab bit changes the output state of flip-flop 102. An end of line scan detector 103 detects the end of each scan line—i.e., every 256th bit—in the output signal from the read x-y address generator to apply a reset signal to flip-flop 102. So flip-flop 102 begins every scan line with its output signal in a state which is not such as will enable turning on each of CRT 40 electron beam for painting the field. If a boundary of a field is crossed flip-flop 102 will be triggered into its other state, with its output signal in a state which is such as will enable the generation of each CRT 40 electron beam used to paint the field.

Figure 7:
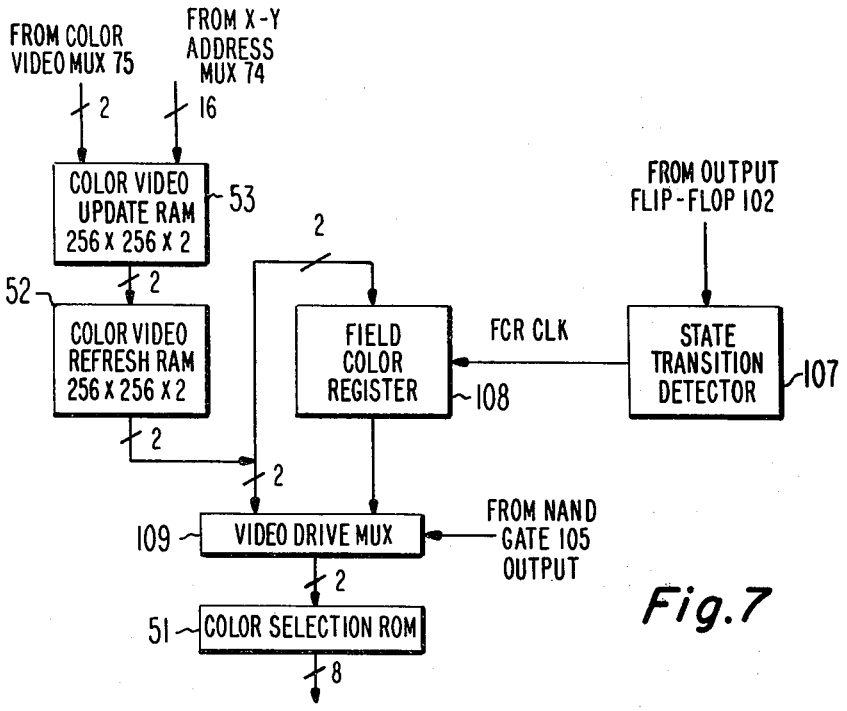

Each CRT 40 electron beam used to paint the field will be turned on only if there is no symbol of higher priority in the memory comprising RAM's 52–57, 79, and 100, however. This is determined by checking the condition of the priority RAM 79 or 101 being read from during that display frame. FIG. 6 shows a NAND gate 104 being used to apply "ones" to inputs of OR gates 105 and 106 if and only if the information from priority RAM 79 or 101 has the lowest priority, and the flip-flop 102 output is "zero", indicating that a left-hand boundary of the field has been crossed. The application of these "ones" to their inputs causes OR gates 105 and 106 to present "ones" in their outputs to the color selection ROM 51 irrespective of information received from the color video RAM 52 or 53 being read, and the "double-one" condition is selected as the code describing the field color. So the electron beams required for painting the field are turned on. This jamming control of the signal applied to the color selection ROM 51 will be exercised only as long as NAND gate 104 produces a "one" in its output. The appearance of priority information other than "double-zero" from the one of priority RAM's 79 and 101 being read from, as occurs during a portion of the field a line vector or symbol is superimposed upon, will cause the output of NAND gate 104 to fall to "zero"; and the output of the color video RAM 52 or 53 being read from will control the outputs of OR gates 105 and 106 and the color of trace on the CRT 40 screen 41. If the right-hand or lower boundary of the field has not been reached after the line vector or symbol has been traversed by scan, the re-establishment of the "double-zero" condition in the output of the one of priority RAM's 79 and 101 being read from, re-establishes a "one" in the NAND gate 104 output and jamming control of trace color by field is re-established. When the right-hand boundary of the field is crossed, the field tab bit supplied from field tab RAM 98 or 99 will trigger flip-flop 102 into its other condition. Flip-flop 102 then supplies a "one" to its input of NAND gate 104 causing NAND gate 104 output to fall to "zero", so the outputs of OR gates 105 and 106 are determined by their inputs from the one of color video RAM's 52 and 53 being read from.

Where more than one color of field is to be written, one may use a suitable plurality of memory planes in each field tab RAM 98 and 99 and replace OR gates 105 and 106 with more sophisticated logic to establish jamming control of field color. However, it is usually most economical of memory to code the color of the field into its boundary vectors (which may be written at lowest or next to lowest priority). Then the color of the field can be established as shown in FIG. 7. A state-transition detector 107 responds to the setting of field tab flip-flop 102 to clock the contents of the one of color video RAM's 52 and 53 being read, into a color register 108 (with as many bits as supplied from RAM's 52 and 53) to be stored for the duration of the line painting the field. A field drive multiplexer 109 responds to the output of NAND gate 105 to apply the contents of register 108, rather than that from the one of color video RAM's 52 or 53 being read, to the input of color selection ROM 51 so long as the line painting the field is not interdicted by a symbol or line vector of higher priority or discontinued by the field tab flip-flop 102 changing its state.

Other modifications of the system described above may be made in the interest of reducing memory requirements. As a first example, the absence of trace condition can be stored in one of the code conditions of the correction memory planes rather than in the color video memory planes; this is advantageous when only one more color condition is needed which would otherwise cost an additional memory plane in color video memory, slight loss of correction resolution being the price paid for this saving. As a second example, if one is satisfied with always beginning and ending a line vector at one of the 256 locations along the axis for which positional correction is not dynamically afforded, one can apply the output of the battery 96 of OR gates in FIG. 4 directly to correction memory shared for x- and y-correction and multiplex after retrieval from memory to effect correction in the desired direction parallel to the x or y axis. An extra memory plane will be required to store the bits that identify whether x-correction or y-correction is used at each pixel location. The FIG. 2 processor can be programmed to furnish instructions for generating the display in order of increasing priority; the update RAM's 53, 55 and 57 then can be re-written by the later, more important data. This will allow the memory for priority bits to be reduced in size, or even eliminated altogether, together with supporting circuitry for it (e.g., such as multiplexer 78).

Let the utilization of the parallel-bit streams furnished digital-word-by-digital-word each read interval of the RAM's (from the cyclic reading of the update RAM's 53, 55, and 57 for one raster scan interval followed by the reading of the refresh RAM's 52, 54 and 56 for three succeeding scan intervals) be more specifically considered. In an EADI system built in accordance with the foregoing description, the four parallel x-correction bit streams are converted in converter 58 to a unidirectional analog current with amplitude proportional to the binary number conveyed by those bit streams, which current is applied to the minor horizontal deflection coil 46; and the four parallel y-correction bit streams are converted in converter 59 to a unidirectional analog current with amplitude proportional to the binary number conveyed by these bit streams, which current is applied to the minor vertical deflection coil 47. This arrangement tends to use more power than a system wherein the converters 58 and 59 supply analog current that is zero-valued when the desired pixel locations do not vary from their normal positions during raster scan, and wherein currents proportional to departure of the pixel from normal location are supplied in positive or negative polarities by the converters 58 and 59. A digital-to-analog deflection converter of either form can be designed by an electronic circuit designer of normal skill.

The data stored in the x-correction and y-correction portions of display memory can be used in other ways to correct the position or apparent position of electron beam trace. As one example, consider the following modification to be used instead of the minor deflection coil controlling fine positioning in the direction of rapid scan, and the digital-to-analog-deflection converter driving the coil. An electrically controlled delay circuit is inserted into each video signal channel controlling the emission of electrons from one of the CRT 40 electron guns (normally before video amplifier output stages in the digital-to-analog video converter 50). The amount of delay afforded by this circuit is to be controlled by the binary number formerly applied to the now-dispensed-with digital-to-analog-deflection converter.

Figure 8:
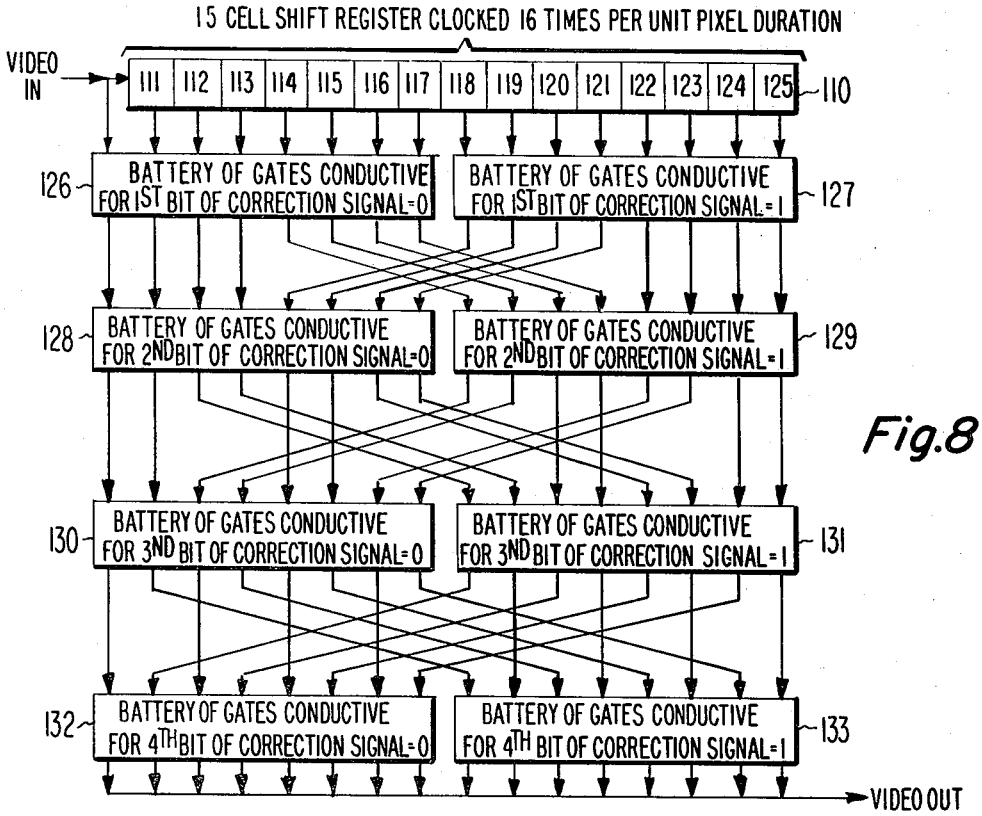
FIG. 8 is a block schematic diagram of an electrically controlled video delay circuit useful in implementing a modification of the FIG. 3 display system embodying an aspect of the invention.

FIG. 8 shows a suitable electrically controlled delay circuit. Each video input signal is clocked from left to right through successive ones of the fifteen cells 111–125 of a shift register 110 at a rate sixteen times the rate the memory RAM's 52–57 are addressed for reading. Batteries 126, 127, 128, 129, 130, 131, 132, and 133 of gates complete connections between respective ones of their inputs and the outputs disposed directly below those inputs in FIG. 8, responsive to those conditions of the correction signal indicated on the blocks symbolizing the batteries of gates; for the opposite conditions the gates in these batteries interrupt these connections. The outputs of the lowest-rank batteries 132, 133 of gates are connected together to supply video output signal delayed proportional to the binary number encoding the correction signal, which correction signal is that which previously supplied the now-dispensed-with digital-to-analog deflection converter.

When the display system uses the "field tab" method of writing field information, controlled video delay has advantage over the use of the minor deflection coil for fine-positioning the trace in the direction of rapid scan, in that it affords correction (without distracting side-effects) in the step discontinuities in field boundaries that form a smaller acute angle with the direction of slow scan than with the direction of rapid scan. E.g., the display of FIG. 1 can have the lower boundary of the blue field representing the sky corrected for step discontinuities, as long as the angle of bank does not exceed 45°, by arranging the display system presenting it to have relatively rapid vertical scan and relatively slow horizontal scan (departing from conventional television practice) and to use "field tab".

What is claimed is:

1. A raster-scanned display system with improved positional resolution comprising:

a cathode ray tube provided with an electroluminescent screen and with a first electron gun connected for responding to a first video signal to project a first electron beam of varying intensity towards its screen;

a raster scanning signal generator means for generating recurrent first and second deflection current signals varying at respective sweep rates that are relatively slow and relatively fast respective to each other;

a first principal deflection winding connected to conduct said first deflection current signal and arranged for responding to said first deflection current signal to deflect each electron beam of said cathode ray tube to sweep its screen in directions parallel to a first axis;

a second principal deflection winding connected to conduct said second deflection current signal and arranged for responding to said second deflection current signal to deflect each electron beam of said cathode ray tube to sweep its screen in directions parallel to a second axis orthogonal to the first;

means for generating a stream of individual pixel information as digital code words;

means for applying said first video signal to said cathode ray tube responsive to a first portion of each digital code word;

means responsive to a second portion of each digital code word for generating a first minor deflection signal capable of varying at video rate; and first auxiliary deflection means for responding to said first minor deflection signal to deflect each electron beam of said cathode ray tube in directions parallel to said first axis across its screen by amounts smaller than the sweeps parallel to said first axis afforded by said first principal winding in the interval between successive sweeps in said second direction.

2. The improved raster scanned display system as set forth in claim 1 wherein said first auxiliary deflection means includes a first auxiliary deflection winding and wherein said means for generating a first auxiliary deflection signal includes digital-to-analog converter means for converting said second portion of each digital code word in said stream of individual pixel information to a first minor deflection signal current applied to said first auxiliary deflection winding.

3. An improved raster-scanned display system as set forth in claim 2 wherein said cathode ray tube is a color kinescope with its first electron gun positioned to selectively excite a pattern of phosphors electroluminescent in a first color on its screen and with at least one further electron gun positioned to selectively excite a pattern of phosphors electroluminescent in a second color on its screen and wherein there is provided:

means for responding to a further respective portion of each digital code word in said stream of pixel information for generating a respective video signal for controlling the intensity of the electron beam of each further electron gun.

4. A raster-scanned deflection display system as set forth in claim 2 or 3 including:

means for converting a third portion of each digital code word in said stream of individual pixel information to a second minor deflection signal current capable of varying at video rate; and a second auxiliary deflection winding responsive to said second minor deflection signal current being applied thereto for deflecting each electron beam of said cathode ray tube across its screen in directions parallel to said second axis by amounts of the same order provided by said first auxiliary deflections means.

5. A raster-scanned deflection display system as set forth in claim 2 or 3 including:

means responsive to a third portion of each digital code word for generating a second minor deflection signal varying at video rate; and second auxiliary deflection means for responding to said second minor deflection signal to deflect each electron beam of said cathode ray tube across its screen in directions parallel to said second axis by amounts of the same order provided by said first auxiliary deflection means.

6. A raster-scanned deflection display system as set forth in claim 5 wherein said second auxiliary deflection means is an electrically controlled delay apparatus connected for delaying each said video signal according to said second minor deflection signal.

7. A raster-scanned display system with improved positional resolution comprising:

a cathode ray tube provided with an electroluminescent screen and with a first electron gun connected for responding to a first video signal to project a first electron beam of varying intensity towards its screen;

a raster scanning signal generator means for generating recurrent first and second deflection current signals varying at respective sweep rates that are relatively fast and relatively slow respective to each other;

a first principal deflection winding connected to conduct said first deflection current signal and arranged for responding to said first deflection current signal to deflect each electron beam of said cathode ray tube to sweep its screen in directions parallel to a first axis;

a second principal deflection winding connected to conduct said second deflection current signal and arranged for responding to said second deflection current signal to deflect each electron beam of said cathode ray tube to sweep its screen in directions parallel to a second axis orthogonal to the first;

means for generating a stream of individual pixel information as digital code words;

means for applying said first video signal to said cathode ray tube responsive to a first portion of each digital code word;

means responsive to a second portion of each digital code word for generating a first minor deflection signal capable of varying at video rate; and first auxiliary deflection means for responding to said first minor deflection signal to deflect each electron beam of said cathode ray tube in directions parallel to said first axis across its screen by amounts smaller than the sweeps parallel to said first axis afforded by said first principal winding in the interval between successive ones of said digital code words.

8. A raster-scanned deflection display system as set forth in claim 7 wherein said first auxiliary deflection means includes an electrically controlled delay apparatus connected for delaying each said video signal according to said first minor deflection signal.

9. An improved raster-scanned display system as set forth in claim 7 wherein said first auxiliary deflection means includes a first auxiliary deflection winding, the current through which is caused to vary in direct response to said first minor deflection signal.

10. An improved raster-scanned display system as set forth in claim 8 or 9 wherein said means for generating a first auxiliary deflection signal includes digital-to-analog converter means for converting said second portion of each digital code word in said stream of individual pixel information to said first minor deflection signal.

11. An improved raster-scanned display system as set forth in claim 10 wherein said cathode ray tube is a color kinescope with its first electron gun positioned to selectively excite a pattern of phosphors electroluminescent in a first color on its screen and with at least one further electron gun positioned to selectively excite a pattern of phosphors electroluminescent in a second color on its screen and wherein there is provided:

means for responding to a further respective portion of each digital code word in said stream of pixel information for generating a respective video signal for controlling the intensity of the electron beam of each further electron gun.

12. A display system having:

a display device with a display screen;

first sweep means for providing a relatively slow sweep across said display screen;

second sweep means for providing a relatively fast sweep across said display screen, tracing along a path orthogonal to that traced by the slow sweep, means for modulating the brightness of display at video rates responsive to an electric amplified video signal;

means for supplying said video signal over a video bandwidth with an upper limit, which means includes a video amplifier having a video bandwidth response between an input and an output thereof substantially no greater than said video bandwidth with an upper limit, which video bandwidth response is in the range of a few Megahertz, and includes a source of video signal capable of change at video rates substantially as high as will fit within said video bandwidth with upper limit; and auxiliary deflection means capable of changing the rate of relatively fast tracing at video rates, for providing positional resolution on said display screen a number of times more than that conventionally associated with said upper limit on video bandwidth.

13. A display system having:

first sweep means for providing a relatively slow sweep;

second sweep means for providing a relatively fast sweep tracing along a path orthogonal to that traced by the slow sweep;

means for providing display brightness information at video rates in electric signal form;

means for providing minor positional adjustment information at video rates; and means for time delaying said display brightness information while in electric signal form in amount dependent on said minor positional adjustment information provided at video rates, thereby to develop display brightness information of substantially increased spatial bandwidth for controlling display brightness.

* * * * *